United States Patent [19]

Conklin et al.

[11] Patent Number: 4,767,669

[45] Date of Patent: Aug. 30, 1988

[54] MELT SIZE COMPOSITIONS CONTAINING SURFACTANTS

[75] Inventors: Delano M. Conklin, Burlington; John H. Hansen, Greensboro; Norbert W. Burske, Guilford; Robert C. Malpass, High Point, all of N.C.

[73] Assignee: Burlington Industries, Inc., Greensboro, N.C.

[21] Appl. No.: 40,588

[22] Filed: Apr. 21, 1987

[51] Int. Cl.[4] ..... D06M 15/19; D06M 15/263; C08L 23/08; C08L 33/08

[52] U.S. Cl. ..... 428/394; 8/115.6; 428/395; 524/275; 524/313; 524/321; 524/376; 524/377; 524/489; 524/556

[58] Field of Search ..... 8/115.6; 428/394, 395; 524/275, 313, 321, 489, 556, 376, 377

[56] References Cited

U.S. PATENT DOCUMENTS

| | | | |
|---|---|---|---|
| 4,027,346 | 6/1977 | Wada et al. . | |
| 4,082,883 | 4/1978 | Malpass et al. | 428/275 |
| 4,136,069 | 1/1979 | Vachon et al. . | |
| 4,237,016 | 12/1980 | Rudkin et al. . | |
| 4,401,782 | 8/1983 | Gonklin et al. . | |

*Primary Examiner*—Herbert J. Lilling
*Attorney, Agent, or Firm*—Nixon & Vanderhye

[57] ABSTRACT

Quick setting, nonaqueous melt size compositions suitable for application as a melt to textile yarns, and for later removal by solvent or aqueous means, include substantially equal amounts of an 80/20 ethylene/acrylic acid copolymer and a wax such as hydrogenated tallow intimately blended with a smaller amount of sebacic acid or dodecanedioic acid together with an amount of a nonionic surfactant to facilitate size removal.

8 Claims, No Drawings

MELT SIZE COMPOSITIONS CONTAINING SURFACTANTS

This invention relates to the hot melt sizing of textile warp yarns and, more specifically to a novel class of nonaqueous melt sizes which are applied to a yarn in the form of a melt and readily form a thin film on the outside surface of the yarn yet are easily removed from the yarn when the knitting or weaving procedure is completed.

BACKGROUND OF THE INVENTION

In the process of textile sizing, a composition usually called size, commonly in the form of an aqueous solution, is temporarily applied to individual textile warp yarn threads or strands to protect them from the physical abuse of the weaving knitting operation. Once the weaving or knitting operation is complete, the size is removed, preferably by washing in hot water. This type of sizing is not to be confused with the application of size to a finished textile fabric to stiffen it, to add weight, or for some other purpose.

A class of sizing agents that are applied as a melt and rigidify at room temperature are known as melt sizes or sometimes hot melt sizes. Melt size compositions of several types have been described in the patent literature and other literature as well, including compositions based upon wax or wax modified with a polymer or copolymer soluble in the wax. Blends of high molecular weight with low molecular weight ethylene/alpha, beta unsaturated carboxylic acid copolymers, such as blends of high with low molecular weight ethylene/acrylic acid copolymers, optionally with up to 50% by weight of a wax, are described in U.S. Pat. No. 4,136,069. Quick-setting, nonaqueous, water-extractable textile melt sizes composed of an intimate blend of from 42 to 58% by weight of an 80/20 ethylene/acrylic acid copolymer and from 58 to 42% by weight of wax derived by full hydrogenation of animal and plant tallows and oils, excluding castor wax, are described in U.S. Pat. No. 4,401,782. While ethylene/acrylic acid copolymers have been successfully blended with an equal weight of less expensive tallow wax, size removal by aqueous or alkali extraction may not be entirely acceptable. This is particularly true of the tallow component of the size. Residual (unremoved) tallow can have profound adverse effects on dyeability and pilling resistance.

It has been discovered that the hot melt size compositions of U.S. Pat. No. 4,401,782 may be improved in water solubility by the inclusion of an effective quantity of a surfactant. According to the present invention, approximately equal weight amounts of fully hydrogenated tallow-type triglyceride wax and a specific ethylene/acrylic acid copolymer are melted together with from 1% to 14% of sebacic acid or dodecanedioic acid and from 1 to 10% of a surfactant comprising a nonionic, ethylene and/or propylene oxide adduct of a $C_{10-15}$ alcohol, as specified in more detail below, to form a superior textile melt size that has acceptable film strength and is easily removed from the yarn on completion of the textile processing operation. Optionally, the copolymer content may be further reduced to as low as about 35 percent by weight by incorporation of from about one to seven percent by weight of a hydrogenated tallow amide or other fatty acid amide.

DETAILED DESCRIPTION OF THE INVENTION

One embodiment of the hot melt size compositions of the present invention comprises an essentially three component melt blend of about 40 to 55 weight percent of substantially 80/20 ethylene/acrylic acid copolymer in conjunction with about 1 to 10% of a surfactant, as described in more detail below, balance fully hydrogenated tallow-type triglyceride wax. Optionally and preferably, the copolymer content may be reduced to as little as about 35 weight percent by incorporation of one of seven percent of $C_{14-20}$ fatty acid amide or one to fourteen percent of sebacic or dodecanedioic acid, provided that the copolymer has a standard melt flow rate value of 250–550 when determined by ANSI/ASTM D pb 1238-79 at condition D. Thus in its broadest aspect, the melt sizes of the present invention comprise melt blends of about 45–58 weight percent of ethylene/acrylic acid copolymer an about 32 to 57 weight percent of a fully hydrogenated triglyceride, such as hydrogenated tallow, from 1 to 7 weight percent of $C_{14-20}$ fatty acid amide or from 1 to about 14 percent of sebacic acid or dodecanedioic acid and from 1 to 10 percent of a nonionic surfactant of the type specified below. The total is 100 percent.

In the three-component sizes of this invention, we have found that composition ranges of about 35 to 50 weight percent of substantially 80/20 ethylene/acrylic acid copolymer and a nearly equal amount of hydrogenated triglyceride with at least the minimum amount, usually 2 weight percent, of the surfactant to impart the desired removal characteristics give the best results, with optimum melt sizing properties being centered around substantially 42:42:5 weight proportions of these three components. The preferred triglyceride is hydrogenated tallow.

In a 4-component embodiment of the invention, the content of ethylene/acrylic acid copolymer in the size may be reduced below about 45 percent, to as low as about 35 percent, without significant loss of sized yarn performance. The melt size of this embodiment comprises about 35 to 45 percent, preferably about 38 to 42 percent, of substantially 80/20 ethylene/acrylic acid copolymer, about 1 to 7 percent, preferably about 2 to 5 percent, of fatty acid amide, 1 to 10 percent surfactant, balance hydrogenated triglyceride preferably in an amount about equal to the ethylene/acrylic acid copolymer. Incorporation of the amide appears to increase the miscibility range of copolymer and hydrogenated triglyceride, thereby permitting the use of less copolymer in the melt size.

The preferred compositions of the present invention, comprising an ethylene/acrylic acid copolymer, hydrogenated triglyceride wax, sebacic acid or dodecanedioic acid, and about 1 to about 10% surfactant, exhibit an expanded range of melt compatibility such that they can be melted and applied to yarn at significantly lower temperatures, i.e., up to around 50° F. lower, than copolymer/tallow blends, yet are easily removed from the yarn upon completing weaving or knitting. Quick-setting nonaqueous textile melt size compositions based upon a blend of an 80/20 ethylene/acrylic acid copolymer, tallow and optionally other modifiers are disclosed in U.S. Pat. No. 4,401,782, the disclosure of which is hereby incorporated by reference.

The low molecular weight ethylene/acrylic acid copolymers employed in the melt sizes of the present invention are themselves well known and commercially available materials. They may be made by methods disclosed in U.S. Pat. Nos. 3,520,861 and 4,515,317 or less preferably be precipitated from emulsion form as in U.S. Pat. No. 3,426,363.

Hydrogenated or hardened tallow is a widely available by-product of the meat-packing industry made principally by hydrogenation of beef tallow. As such it is principally comprised of glyceryl tristearate, with lesser inclusions of mixed glycerides of $C_{14-20}$ saturated fatty acids. Principally because of its currently favorable price and availability, what is conventionally known as "fully hydrogenated" beef tallow (iodine number less than one) is the preferred triglyceride of the invention. Other fully hydrogenated triglycerides, for example those derived from oils and fats such as soybean oil, cottonseed oil, peanut oil, palm oil, lard, and tallow from sheep, goat, and other animal sources, would also be attractive in the present invention should they become economically competitive.

Expressly excluded from the category of triglycerides of the invention is castor wax, the fully hydrogenated derivative of castor oil. Because of the very high proportion of ricinoleic acid in castor oil, castor wax, with its correspondingly high content of 12-hydroxystearic acid moieties, is unsuitable for use as a major component in the melt sizes of the invention.

The fatty acid amides, also commercially known as hydrogenated tallow amides, and commonly made by reaction of free acids or hydrogenated tallow with ammonia, are typically mixtures of $C_{14-20}$ acid amides, principally stearamide. More chemically specific fatty acid amides may of course be employed in the invention, but they will naturally be more expensive.

We have discovered that the hot melt size compositions disclosed in U.S. Pat. No. 4,401,782 may be improved by the inclusion of from 1% to 10% by weight of a surfactant as specified below. Presence of a surfactant in these melt size compositions increases the solubility of the size but decreases the time period in which the melt size can be maintained at elevated application temperatures; this time is called "pot life". The specific type of surfactant and amount included in the melt size composition is governed, to a certain extent, by the composition's pot life and tendency of certain surfactants to cause the viscosity of the molten size to increase after aging, for instance for 6 hours at 365° F. In addition, some surfactants degrade the size film properties, especially the elongation-at-break, thus care must be taken in selecting a suitable surfactant for inclusion in the hot melt size composition.

The general range of the surfactants suitable for melt size compositions of this invention are generally categorized as polyethylene and/or polypropylene glycol ethers and/or esters, where one end of the chain has a free hydroxyl group, and the other end mostly has a long-chain alkyl group derived from an alcohol, thereby creating a poly(alkyleneoxy) ether. In addition, the two polyethylene glycol monostearates below are poly(ethyleneoxy) ether esters which fall within the scope of the present invention. In the preferred capped surfactants, the free hydroxyl group is replaced by methoxy or a similar lower alkoxyl group.

Candidate surfactants for use in the melt size compositions of this invention will have the following characteristics. In general, the surfactant will be a nonionic ethylene and/or propylene oxide adduct of a $C_{10}$ to $C_{18}$ alcohol, preferably having a secondary and/or branched structure with from between 6 and 12 units of oxide adduct. Mixtures of ethylene and propylene oxides give better result than ethylene oxide alone. Increased useful pot life is obtained with those adducts "capped" with a lower alkyl group, particularly methyl capped surfactants having been found to minimize molten aging effects.

The following surfactants are well suited for inclusion in the melt size compositions of this invention:

Min-Foam 1X both are polyethyleneoxy, polypropylenoxy derivatives of 2X $C_{11-15}$ alcohols, from Union Carbide Corp., Danbury, Conn.

Min-Foam 1X both are polyethyleneoxy, polypropyleneoxy derivatives of 2X $C_{11-15}$ alcohols, from Union Carbide Corp., Danbury, Conn.

Mazawet 77—described by Mazer Chemicals Inc., Gurnee, Ill., as a "capped alkyl polyoxyalkylene ether", which is just another way of describing a capped polyalkyleneoxy derivative of an alcohol.

The next three are tradenamed products of Rohm and Haas Co., Philadelphia, Pa.:

Triton DF-12—capped polyethyleneoxy alcohol

Triton DF-18—biodegradable modified alcohol

Triton DF-20—capped polyethyleneoxy alcohol

The next two are trademarked products of Union Carbide Corp., Danbury, Conn.:

Tergitol 25—L—12—$C_{12-15}$ linear alcohols plus twelve moles ethylene oxide

Tergitol 15—S—40—$C_{11-15}$ second alcohols plus 40 moles ethylene oxide

The remaining six are trademarked products of Emery Chemicals, Mauldin, S.C.

Emersist 7232—$C_{12-15}$ alcohol plus ca. 9 moles ethylene glycol

Emery 23114—methyl—capped polyethyleneoxy, polypropyleneoxy derivative of an alcohol Emersist 6735—no identification available; probably a research sample Trycol LAL—4—lauryl alcohol plus ca. 4 moles ethylene oxide Trycol DA—6—$C_{10}$ alcohol plus 4–6 ethylene oxide, propyl capped Trycol LF—1—isodecyl alcohol plus ca. 8 moles ethylene oxide Initial development work was conducted on a basic composition, expressed in terms of weight percent, of:

ethylene/acrylic acid copolymer 42% dodecanedioic acid 6% hydrogenated tallow 42% surfactant of interest 10%

Solubility, viscosity and molten aging characteristics of such sizes were then measured. From these tests one preferred surfactant, tridecyl alcohol reacted with 9 moles ethylene oxide and capped with a methyl group, was identified.

The amount of surfactant is subject to variation depending upon the desired properties of the size and the characteristics of the surfactant, taken with the identities and amounts of the other components of the composition. A minimum amount of 1% is required while a maximum amount of surfactant is indicated by rapid decline in film forming properties. Our experience indicates that an upper limit of about 10% is realistic. A preferred range is about 2 to 7 percent, all of these percentages being based on the size after the surfactant is added.

Besides the named components, minor amounts of other agents such as tracer dyes, antioxidants, and the like may be added to the sizes of the invention, as desired.

Although other means may be employed, the methods and apparatus of U.S. Pat. No. Re. 29,287 are preferred for applying these sizes; the disclosure of this reissue patent is hereby incorporated by reference to the extent that it may be useful in describing the use of melt size compositions of the present invention. Typically, a predetermined amount of hydrogenated tallow is melted while being heated to near smoking temperature, and the ethylene/acrylic acid copolymer is added gradually with stirring until mixing is complete. Next the fatty acid amide and/or dicarboxylic acid, if it is to be employed, is stirred in, followed by the surfactant, and the melt is then poured into suitably dimensioned pans or trays and allowed to cool to solid blocks of size. Rapid cooling is desirable, to minimize component separation. As described in the reissue patent, a size block is then pushed against and into the grooves of a heated rotated applicator roll and the molten size is taken up as the yarn passes tangentially or along an arc of the turning roll.

Desizing can be effected by either conventional alkaline aqueous scours or organic solvents, such as with mixtures of petroleum solvents and methanol as described in U.S. Pat. No. 4,253,840, the disclosure of which is hereby incorporated by reference.

Our experience has shown that in the field of melt sizing there exists a fine balance between the need for relatively high melting and application temperatures, to help insure rapid size solidification of the yarn, and the desire to prevent or at least minimize the tendency for the hot size to fume, smoke, and perhaps to thicken on the applicator roll. Within the preferred application range of 350°–400° F. for the sizes of the present invention, a general preference for the indicated upper temperature limit exists, so long as the sizing operation is proceeding smoothly and without periodic temporary shutdowns for adjustments, yarn breaks, and the like. At about 400° the size is less viscous and flows more freely onto the yarn than at 350° F. Although the tendency to fuming and smoking is naturally greater at the higher temperature, within the entire range it is minimal, much better than the applicants have observed with other high melting sizes.

A significant merit of the present invention which is thought to be related to the limited compatibility of the size components is that the sized yarn performs so well in the loom. Its lack of tendency to build up deposits on heddles and other loom parts is uncommonly good, especially in a size with such high wax content. This characteristic, which applicants associate with lack of tackiness of the sized yarn over wider than usual temperature ranges, is far more significant in a yarn sizing context than mere measurements of size film strengths and elongations.

Probably because of their unusually high resistance to tackiness, the sizes of the present invention can be applied successfully at much higher add-on than most melt sizes, without adverse effect upon either sizing or weaving performance, and are later more easily removed from the woven or knit textile.

DESCRIPTION OF THE PREFERRED EMBODIMENTS

In the examples which follow, several tests are noW described that we consider simpler and more rapid than actual weaving. Many of these tests were employed to evaluate and screen candidate melt sizes of the present invention. As for the melt size composition preparation for initial laboratory screening, small samples of 80/20 ethylene/acrylic acid copolymer, having an indicated standard melt flow rate value (hereinafter referred to as SMFR) of 250–550, as determined by ANSI/ASTM D 1238 at Condition D, were melt-blended with designated amounts of hydrogenated tallow, surfactant and tallow amide or dicarboxylic acid. Typically, for a 50/50 blend, a 30-gram portion of the copolymer was melted, into it was stirred 30 gm of hydrogenated tallow, and the melt was observed for clarity at 400° F. A surfactant was added and the melt was then poured into a 0.5×0.75×7-inch Teflon mold and allowed to cool. Larger-scale samples may be prepared in essentially the same way.

For preliminary screening of the various size compositions on yarn, size was applied to six ends of yarn by urging an end of the molded size stick against a 6-groove laboratory model of the melt applicator roll of the type described in U.S. Pat. No. 29,287. The roll, heated at 400° F., was turned at 10 rpm in the direction of yarn travel while the yarns, traveling at 330 yarns per minute (ypm) unless otherwise indicated, were passed through the grooves at the top of the roll. Tension in grams on the yarn during sizing was measured with a conventional tensiometer.

The following examples refer to the above-described tests; unless otherwise indicated all parts and percentages are by weight. In the appended claims the total weight percentage of the indicated components is 100 weight percent. When included, a component is present in at least an amount of 0.1 weight percent.

EXAMPLE 1

This Example assesses the effect of surfactants on solubility of a size. Films of a size to be tested for solubility were prepared by spreading molten size onto a cool surface. From a relatively smooth area of the film, a 0.1 gram sample—approximately 1 square inch—was cut. The sample was carefully placed on the surface of 150 ml scour solution held at 190° and allowed to stand. In most cases, the time for the sample to begin dissolving was measured. In some cases, time for total solution was also checked.

The scour solution contained 0.25% Penetrant KB, 0.25% Penetrant SDP-2, 0.3% Chelate DPTA-80 and 0.5% NaOH.

Sizes containing 39 g EAA (ethylene/acrylic acid) and 10% DDA (dodecanedioic acid) and the desired amount of surfactant in hydrogenated tallow were prepared for the following group of trials. Trials are listed in order of increasing times for solution.

5% Emery SAL—20 (Stearyl alcohol with ca. 20 moles ethylene oxide)
3% Emery SAL—20
3% Trycol OAL—23 (Oleyl alcohol with ca. 23 moles ethylene oxide
3% Hydrogenated castor oil with ca. 25 moles ethylene oxide
3% Polyethylene glycol (1000) monostearate
3% Hydrogenated castor oil with ca. 5 moles ethylene oxide
Control—no surfactant Following sizes were as those above except that they contained different amounts of DDA.

| DDA | Additive | Solution Times (seconds) Start | Complete |
|---|---|---|---|
| 7% | 15% PEG 1540 monostearate | 8 | 3 min 45 sec. |
| 7 | 15% Glycerol monostearate* | 4 | >5 min |
| 10 | 10% Tergitol 15-S-40 | 10 | 3 min 30 sec. |

*comparative - not according to the invention.

Following sizes contained 42% EAA, 42% hydrogenated tallow, 6% DDA and 10% of the surfactant listed.

| Additive | Solution Times (seconds) Start | Complete |
|---|---|---|
| Tergitol 25-L-12 | 4 | 45 |
| Emersist 7232 | 6 | 15 |
| Tryol LAL-4 | 6 | 15 |
| Tergitol 15-S-40 | 15 | 45 |
| Trycol DA-6 | 6 | 12 |
| Trycol LF-1 | 7 | 15 |
| Emery 23114 | 6 | 14 |

EXAMPLE 2

In this example, the effect of surfactants on molten aging of sizes was studied. Aging of sizes is measured by following the changes in viscosity of samples held at a temperature above their melting points for long periods of time. In this example, viscosities were measured with a Brookfield RVT viscometer equipped with Thermosel heater to maintain constant melt temperature (365° F.). Viscosity changes occurring during periods up to 24 hours were recorded.

In general, viscosity of the melt sizes described here decreased until temperature equilibrium was established, then increased with aging time, but was much more marked in the later stages. For convenience in comparing materials with different initial viscosities, the ratios of viscosity after a given period of aging to the initial minimum viscosity are reported here.

Sizes described in this example contained 42% EAA, 24% hydrogenated tallow, 6% DDA and 10% surfactant.

| Surfactant | Time for Complete Solution (seconds) | Initial Viscosity (cps) | Viscosity Ratio 5 hrs | 10 hrs | 15 hrs | 20 hrs |
|---|---|---|---|---|---|---|
| Min-Foam 1X | 10 | 470 | 1.11 | 1.61 | 2.92 | * |
| Min-Foam 2X | 12 | 425 | 1.10 | 1.54 | 2.64 | * |
| Mazawet 77 | 13 | 378 | 1.05 | 1.32 | 1.79 | 2.64 |
| Triton DF-12 | 13 | 420 | 1.03 | 1.22 | 1.61 | 2.37 |
| Triton DF-18 | 12 | 468 | 1.05 | 1.25 | 1.63 | 2.37 |
| Triton DF-20 | 25 | 470 | 1.01 | 1.08 | 1.27 | 1.55 |
| No surfactant | — | 402 | 1.04 | 1.17 | 1.42 | 1.80 |

*viscosity greater than 2000 cps

Samples of Mazawet 77 with known levels of uncapped material were available. Sizes containing 10% total of these surfactants were prepared and tested as above.

| Mazawet 77 Surfactant | Initial Viscosity (cps) | Viscosity Ratio 5 hrs | 10 hrs | 15 hrs | 20 hrs |
|---|---|---|---|---|---|
| No surfactant | 402 | 1.04 | 1.17 | 1.42 | 1.80 |

-continued

| Mazawet 77 Surfactant | Initial Viscosity (cps) | Viscosity Ratio 5 hrs | 10 hrs | 15 hrs | 20 hrs |
|---|---|---|---|---|---|
| Hydroxyl # 6.1 | 352 | 1.04 | 1.19 | 1.39 | 1.74 |
| 6.1 & 24.2, 50/50 Blend | 402 | 1.05 | 1.29 | 1.68 | 2.43 |
| Hydroxyl # 24.2 | 405 | 1.08 | 1.36 | 1.88 | 3.05 |

EXAMPLE 3

This example investigatae the use of small amounts of surfactant. Small batches (400 gm each) of melt sizes of the compositions shown below were prepared:

| Sample | Polymer (%) | Triton DF-12 (%) | DDA (%) | Hydrogenated Tallow (%) |
|---|---|---|---|---|
| A | 42 | — | 6 | 50 |
| B | 42 | 4 | 6 | 48 |
| C | 42 | 7.5 | 6 | 44.5 |
| D | 41 | — | 6 | 53 |
| E | 41 | 1 | 6 | 52 |
| F | 41 | 2 | 6 | 51 |
| G | 41 | 4 | 6 | 49 |

Viscosities of the 7 sizes as prepared above were measured at 375° F.

| Sample | Inital Viscosity (%) | Viscosity Ratio 5 hrs | 10 hrs | 15 hrs | 20 hrs |
|---|---|---|---|---|---|
| A | 418 | 1.08 | 1.34 | 1.84 | 2.74 |
| B | 412 | 1.12 | 1.49 | 2.29 | 4.67 |
| C | 408 | 1.11 | 1.56 | 2.67 | — |
| D | 382 | 1.05 | 1.30 | 1.78 | 2.64 |
| E | 3.78 | 1.07 | 1.34 | 1.91 | 3.15 |
| F | 378 | 1.08 | 1.40 | 2.06 | 3.76 |
| G | 372 | 1.09 | 1.47 | 2.31 | 5.00 |

Films, 3 to 4 mils in thickness, were prepared by extruding molten sizes, at about 350° F., onto a cool, polished metal surface. Strips of these films were pulled apart in an Instron tester, as soon after preparation as feasible.

| Sample | Size Film Properties Yield (psi) | Elongation-at-Break (%) |
|---|---|---|
| A | 1206 | 362 |
| B | 924 | 59 |
| C | 703 | 68 |
| D | 1326 | 213 |
| E | 1302 | 117 |
| F | 1147 | 155 |
| G | 1098 | 57 |

The sizes were also applied to yarns at 375° F. Laboratory tests indicated that the resistance of the sized yarns to abrasion decreased as the amount of surfactant in the formulation was increased. The sized yarns were also woven into fabrics. Fray counts of yarns removed from these fabrics indicated that there were no significant differences in loom abrasion among the samples.

This invention may be embodied in these forms or carried out in other ways without departing from the spirit or essential characteristics thereof. The present embodiments are thus illustrative, the scope of our invention being indicated by the appended claims and the equivalents embraced therein.

What is claimed is:

1. A quick-setting, nonaqueous, readily water-extractable textile melt size composition comprising an intimate mixture of:

about 42 to about 58 weight percent of substantially 80/20 ethylene/acrylic acid copolymer, about 32 to about 57 weight percent of a wax derived by full hydrogenation of animal and plant tallows and oils, excluding castor wax, and from about 1 weight percent to about 10 weight percent of nonionic surfactant that is an ethylene, propylene or ethylene and propylene oxide adduct of a $C_{10}$–$C_{18}$ alcohol, said size capable of being applied as a melt to textile yarns, with quick setting when exposed to ambient conditions, and capable of being removed from the yarns by aqueous or alkali extraction.

2. The size of claim 1 in which the surfactant is a polyethylene glycol, polypropylene glycol or polyethylene and polypropylene glycol ester or ether in which one end of the ester or ether has a free hydroxyl group.

3. The size of claim 2 in which the free hydroxyl group of the surfactant is replaced by a lower alkoxy group.

4. The size of claim 1 in which the amount of surfactant is from about 2 weight percent to about 7 weight percent.

5. Yarn sized with the composition of claim 1.

6. The sized yarn of claim 5 in which the yarn contains polyester, rayon, a blend of polyester and rayon, cotton, a blend of polyester and cotton, polypropylene, wool or glass.

7. A quick-setting, nonaqueous, water-extractable textile melt size composition comprising an intimate mixture of:

about 35 to about 50 weight percent of substantially 80/20 ethylene/acrylic acid copolymer, about 40 to about 60 weight percent of a wax derived by full hydrogenation of animal and plant tallows and oils, excluding castor wax, from about 1 to about 14 weight percent of sebacic acid or dodecanedioic acid, and from about 1 weight percent to about 10 weight percent of nonionic surfactant that is an ethylene oxide, propylene oxide or blend of ethylene and propylene oxide adducts of $C_{10}$–$C_{18}$ alcohol said size capable of being applied as a melt to a textile yarn, with quick setting when exposed to ambient conditions, and capable of being removed from the yarns by aqueous or alkali extraction.

8. The size composition of claim 7, in which the yarn contains polyester.

* * * * *